US009976797B2

(12) United States Patent
Lee et al.

(10) Patent No.: US 9,976,797 B2
(45) Date of Patent: May 22, 2018

(54) REFRIGERATOR

(71) Applicant: SAMSUNG ELECTRONICS CO., LTD., Suwon-si, Gyeonggi-do (KR)

(72) Inventors: Tae Youl Lee, Suwon-si (KR); Bok Hyun Jang, Suwon-si (KR); Hyun Joo Kim, Suwon-s (KR); Eun Hea Joo, Seoul (KR); In-Sung Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days. days.

(21) Appl. No.: 15/372,845

(22) Filed: Dec. 8, 2016

(65) Prior Publication Data

US 2017/0167778 A1 Jun. 15, 2017

(30) Foreign Application Priority Data

Dec. 10, 2015 (KR) ..... 10-2015-0175709

(51) Int. Cl.
*A47B 96/04* (2006.01)
*F25D 23/04* (2006.01)
(Continued)

(52) U.S. Cl.
CPC ..... *F25D 23/04* (2013.01); *A47B 88/14* (2013.01); *F25D 11/02* (2013.01); *F25D 23/067* (2013.01);
(Continued)

(58) Field of Classification Search
CPC ..... F25D 23/04; F25D 23/067; F25D 23/069; F25D 11/02; F25D 25/025;
(Continued)

(56) References Cited

U.S. PATENT DOCUMENTS 4,458,964 A * 7/1984 Hardy ..... A47B 88/402 312/333
5,004,305 A * 4/1991 Montuoro ..... F25D 23/04 312/350
(Continued)

FOREIGN PATENT DOCUMENTS

CN 101644520 10/2011
CN 104344674 2/2015
(Continued)

OTHER PUBLICATIONS

European Search Report dated Apr. 11, 2017 in corresponding European Application No. 16 20 2766.
(Continued)

*Primary Examiner* — Hanh V Tran
(74) *Attorney, Agent, or Firm* — Staas & Halsey LLP

(57) ABSTRACT

A refrigerator is provided including a main body having a storage chamber, a door coupled with the front surface of the main body, to open or close the storage chamber, and a case having a rear surface facing the rear surface of the door the front part of the case having an opening. A container is in the case. A sliding apparatus enables the container to slide to be inserted into or pulled out of the case through the opening and includes a guide rail at a bottom of the container, an inclined guide portion in the case to guide the guide rail, a fixing rib at the rear end of the guide portion including a streamlined shape at the front end of the fixing rib and a supporting rib in the container supported by the fixing rib to prevent the container from moving.

8 Claims, 26 Drawing Sheets

(51) Int. Cl.

| | |
|---|---|
| ***A47B 88/14*** | (2006.01) |
| ***F25D 11/02*** | (2006.01) |
| ***F25D 23/06*** | (2006.01) |
| ***F25D 25/02*** | (2006.01) |

(52) U.S. Cl.
CPC ..... *F25D 23/069* (2013.01); *F25D 25/025* (2013.01); *A47B 2210/175* (2013.01); *F25D 2400/04* (2013.01); *F25D 2400/06* (2013.01)

(58) Field of Classification Search
CPC . F25D 2400/04; F25D 2400/06; A47B 88/14; A47B 2210/175
See application file for complete search history.

(56) References Cited

U.S. PATENT DOCUMENTS 5,785,400 A * 7/1998 Grieser ..... A47B 88/467 312/330.1
9,285,160 B1 * 3/2016 Kang ..... F25D 25/025
9,429,354 B2 * 8/2016 Ha ..... F25D 23/006
9,488,405 B2 * 11/2016 Lee ..... F25D 25/025
2004/0011075 A1 * 1/2004 Eveland ..... F25D 11/02 62/441
2006/0049731 A1 * 3/2006 Choi ..... F25D 25/025 312/330.1
2006/0250063 A1 * 11/2006 Czach ..... F25D 23/04 312/405.1
2007/0103044 A1 * 5/2007 Amaral ..... F25D 25/024 312/334.46
2007/0157655 A1 * 7/2007 Eveland ..... A47F 1/087 62/377
2008/0036346 A1 * 2/2008 Kobayashi ..... A47B 67/04 312/334.1
2009/0309472 A1 * 12/2009 Park ..... F25D 25/025 312/401
2010/0147011 A1 * 6/2010 Kang ..... F25C 1/04 62/344
2010/0270902 A1 * 10/2010 Kim ..... F25D 17/042 312/405.1
2011/0005262 A1 * 1/2011 Kang ..... F25C 5/182 62/344
2011/0127896 A1 * 6/2011 Anderson ..... F25D 25/025 312/404
2011/0219805 A1 * 9/2011 Youn ..... F25D 11/02 62/331
2011/0239687 A1 * 10/2011 Lim ..... F25D 23/025 62/344
2012/0017626 A1 * 1/2012 Hwang ..... F25C 1/24 62/340
2012/0126680 A1 * 5/2012 Lee ..... F25D 25/025 312/408
2013/0081422 A1 * 4/2013 Park ..... F25D 11/00 62/448
2013/0119846 A1 * 5/2013 Seo ..... F25D 23/04 312/404
2013/0257254 A1 * 10/2013 Austin ..... F25D 25/025 312/404
2013/0278126 A1 * 10/2013 Jang ..... F25D 25/021 312/404
2014/0300264 A1 * 10/2014 Park ..... F25D 25/025 312/404
2015/0176887 A1 * 6/2015 Castro Solis ..... F25D 25/025 312/405.1
2015/0198365 A1 * 7/2015 Chellappan ..... F25D 23/04 312/298
2016/0161174 A1 * 6/2016 Yi ..... F25D 23/067 62/285

FOREIGN PATENT DOCUMENTS

JP 2010-38495 2/2010
JP 2010203735 A * 9/2010 ..... F25D 23/067
KR 1999-0020203 6/1999
KR 10-0780836 11/2007
KR 10-2012-009651 2/2012
KR 10-2004-0017190 2/2014

OTHER PUBLICATIONS

European Communication dated Feb. 5, 2018 in European Patent Application No. 16202766.8.

* cited by examiner

REFRIGERATOR

CROSS-REFERENCE TO RELATED APPLICATIONS

This application claims the priority benefit of Korean Patent Application No. 10-2015-0175709, filed on Dec. 10, 2015 in the Korean Intellectual Property Office, the disclosure of which is incorporated herein by reference.

BACKGROUND

1. Field

Embodiments of the present disclosure relate to a refrigerator capable of easily separating a container from a door.

2. Description of the Related Art

In general, a refrigerator is a home appliance that includes a storage chamber for storing food and a cool-air supply apparatus for supplying cool air to the storage chamber to store food fresh for a long time.

The inside temperature of the storage chamber is maintained within a specific temperature range required to store food fresh.

Also, the front part of the storage chamber of the refrigerator opens, and the open front part of the storage chamber is closed by a door at ordinary time in order to maintain the inside temperature of the storage chamber.

In the rear surface of the door, a plurality of containers are disposed to store food, etc., and the containers should be separated from the door in order to efficiently use the inside space of the container.

In general, the containers are fixed on the rear surface of the door or configured to slidingly move by a rail structure.

If the containers are fixed on the door, there is limitation in using the inside space of the containers, and although the containers are configured to slide by a rail structure, there are difficulties in separating the containers from the door since the rail structure is used to make the containers slide.

SUMMARY

Therefore, it is an aspect of the present disclosure to provide a refrigerator capable of easily separating a container from a door by improving the structure of a sliding apparatus for enabling the container to slide.

Additional aspects of the disclosure will be set forth in part in the description which follows and, in part, will be obvious from the description, or may be learned by practice of the disclosure.

In accordance with an aspect of the present disclosure, a refrigerator includes a main body having a storage chamber, a door rotatably coupled with the front surface of the main body, and configured to open or close the storage chamber, a case fixed on the rear surface of the door such that the rear surface of the case faces the rear surface of the door, wherein the front part of the case has an opening, a container removably accommodated in the inside of the case and a sliding apparatus configured to enable the container to slide to be inserted into or pulled out of the case through the opening, wherein the sliding apparatus includes a guide rail formed in both edges of the bottom of the container, a guide portion disposed in the case, and configured to guide the guide rail, wherein the guide portion is inclined upwardly toward the front end from the rear end, a fixing rib formed at the rear end of the guide portion, wherein a streamlined shape is formed at the front end of the fixing rib and a supporting rib formed in the container, and supported by the fixing rib to prevent the container from moving.

A roller coupling portion may be formed in the front end of the guide portion, and a roller for guiding the guide rail to enable the container to smoothly slide is rotatably coupled with the roller coupling portion.

In the front end of the guide rail, a stopper groove may be formed in which the roller is accommodated to fix the container when the container is accommodated in the inside of the case, and in the rear end of the guide rail, a stopper may be formed and fixed at the roller to limit a movement distance of the container when the container is pulled out of the case.

The supporting rib is supported by the lower surface of the fixing rib, and may move in a front-rear direction while being supported on the fixing rib when the container is inserted into the case or pulled out of the case through the opening.

When the container is inserted into the case or pulled out of the case through the opening, the supporting rib is supported by the fixing rib to prevent the container from moving upward or downward, while preventing the container from escaping from the case.

When the container is accommodated in the inside of the case, the roller is accommodated in the stopper groove to prevent the container from moving in the front-rear direction.

When a user grips a handle that is upwardly concave from the front lower end of the container and pulls the container in a front direction to take the container out of the case through the opening, the roller and the guide portion guide the guide rail to move the container in the front direction, and the supporting rib is supported by the fixing rib to be guided along the lower surface of the fixing rib to move in the front direction.

If the stopper is fixed by the roller when the container moves in the front direction, the container stops without moving in the front direction, and the supporting rib is supported by the front end of the fixing rib so as to prevent the front portion of the container from tilting downward.

If the user grips the handle to pull the container in the front direction when the stopper is fixed at the roller so that the container is completely pulled out of the case, the supporting rib is guided by the streamlined shape of the fixing rib so that the front end of the container is lifted upward, and the container is separated from the case.

In accordance with an aspect of the present disclosure, a refrigerator includes a main body having a storage chamber, a door rotatably coupled with the front surface of the main body, and configured to open or close the storage chamber, a case fixed on the rear surface of the door such that the rear surface of the case faces the rear surface of the door, wherein the front part of the case has an opening, a container removably accommodated in the inside of the case and a fixing apparatus configured to enable the container to be fixed at or released from the case, wherein the fixing apparatus includes a fixing hole including a fixing portion formed in both side walls of the case and configured to fix or release the container, and an exit portion configured to enable the container released from the fixing portion to escape from the case and a lever including a fixing protrusion coupled with both side walls of the container, and configured to be fixed at or released from the fixing portion and to escape from the case through the exit portion when the fixing protrusion is released from the fixing portion.

The width of the exit portion may increase gradually toward the front direction from the fixing portion.

A coupling rib with which a lever case is coupled is formed in the side walls of the container, and the lever case may comprise a handle inserted into and coupled with the coupling rib, a plurality of coupling holes which are formed in one edge of the handle and with which the lever is coupled, and a fixing rib formed above the plurality of coupling holes and spaced from the plurality of coupling holes.

The lever may comprise a coupling portion including a plurality of coupling protrusions inserted into and coupled with the plurality of coupling holes and fixed by the fixing rib, an extension portion extending from the coupling portion and having a length that is longer than the width of the handle, a pressing portion formed in the extension portion together with the fixing protrusion, and an elastic portion formed below the extension portion and having elasticity to contact the handle.

When the container is accommodated in the inside of the case, the fixing protrusion is fixed at the fixing portion to prevent the container from escaping from the case, if the pressing portion is pressed, the pressing portion rotates downward with respect to the plurality of coupling protrusions fixed by the fixing rib and the fixing protrusion rotates together with the pressing portion to be released from the fixing portion, and if the container moves in the front direction when the fixing protrusion is released from the fixing portion, the fixing protrusion escapes from the case through the exit portion so that the container may be separated from the case.

The case may comprise a cover configured to cover the upper part of the container, and the cover comprises a rear cover fixed at the case, and a front cover rotatably coupled with the front portion of the rear cover.

In accordance with aspect of the present disclosure, a refrigerator includes a main body having a storage chamber, a door rotatably coupled with the front surface of the main body, and configured to open or close the storage chamber, a case fixed on the rear surface of the door such that the rear surface of the case faces the rear surface of the door, wherein the front part of the case has an opening, a container removably accommodated in the inside of the case and a sliding apparatus configured to enable the container to slide to be inserted into or pulled out of the case through the opening, wherein the sliding apparatus includes a guide portion formed in both sides of the bottom of the container, a guide rail disposed in the case, and configured to guide the guide portion and a separating portion formed in the front end of the guide rail and having a width that is wider than the width of the guide rail, wherein the upper part of the separating portion opens.

The guide portion may comprise a connecting portion connected to the bottom of the container, and a guide formed in the lower end of the connecting portion and having a width that is wider than the width of the connecting portion, and the width of the guide rail may be narrower than the width of the guide to prevent the guide from escaping from the guide rail, and wider than the width of the connection portion so that the connecting portion is movable in the front-rear direction.

The width of the separating portion may be wider than the width of the guide, a fixing portion may configure to fix the guide portion moving in the front direction to fix the container is disposed in the separating portion, and the fixing portion comprises a catching portion to fix the guide portion, and an inclined surface formed in the upper surface of the catching portion and inclined upward toward the front end from the rear end.

If the container moves in the front direction, the guide portion moves in the front direction along the guide rail so that the container is taken out of the case through the opening, and the container taken out of the case may be fixed at the catching portion.

If the container moves in the front direction when the front portion of the container is lifted upward in the state in which the guide portion is fixed at the catching portion, the guide portion climbs over the catching portion to move along the inclined surface, and the guide portion moved along the inclined portion escapes from the case through the opened upper part of the separation portion, thereby separating the container from the case.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments of the present disclosure will be described in detail with reference to the accompanying drawings.

A front portion and a front direction which will be mentioned below indicate the front portion of a main body of a refrigerator and a front direction with respect to the main body, respectively, and a rear portion and a rear direction which will be mentioned below indicate the rear portion of the main body of the refrigerator and a rear direction with respect to the main body, respectively.

In the following description about a case and a door guide coupled with the rear surface of a refrigerator door, a front portion and a front direction indicate the front portion of the main body and a front direction with respect to the main body, respectively, when the door opens, and a rear portion and a rear direction indicate the rear portion of the main body and a rear direction with respect to the main body, respectively.

Figure 1:
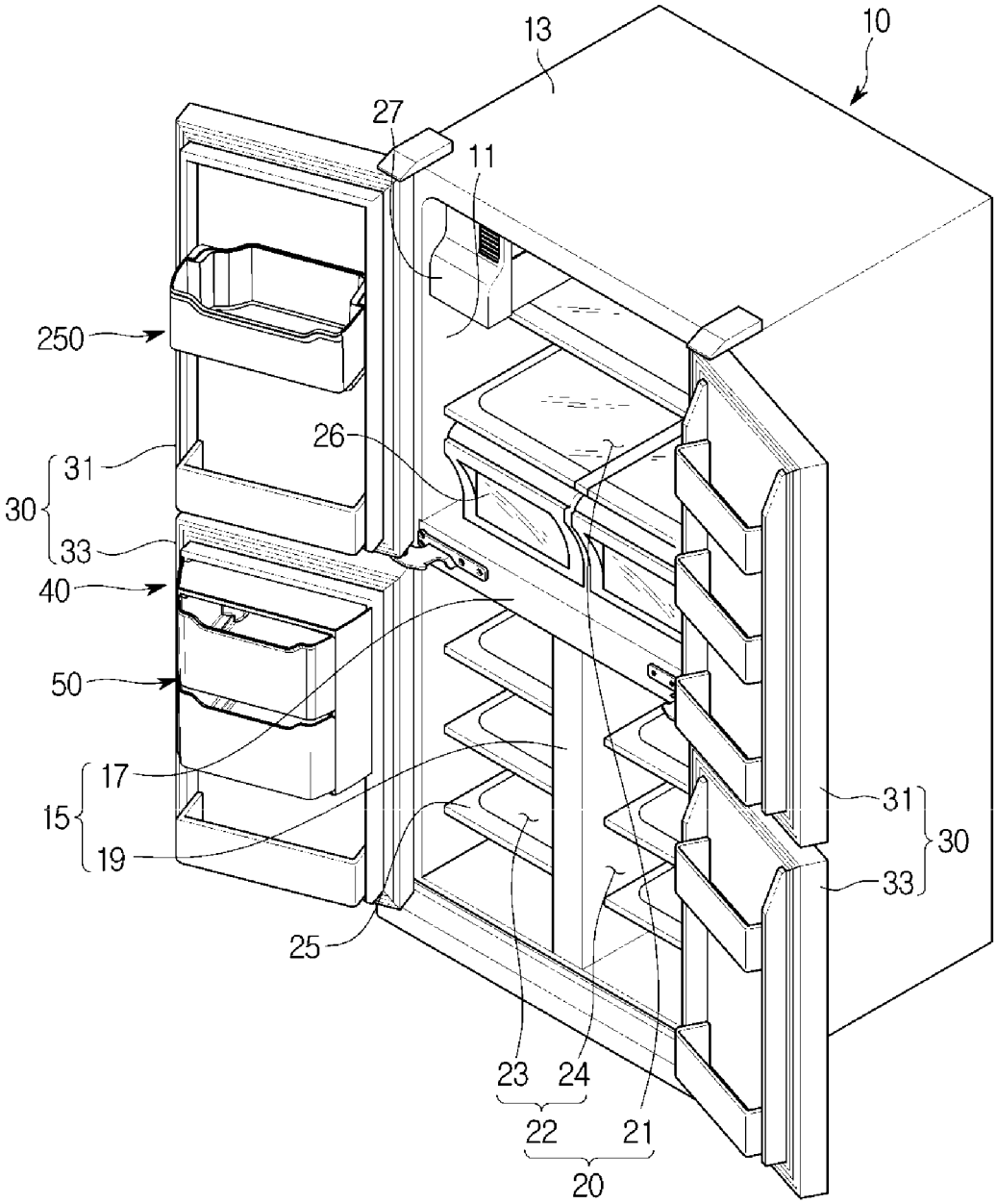
FIG. 1 shows a refrigerator according to an embodiment of the disclosure.
Figure 2:
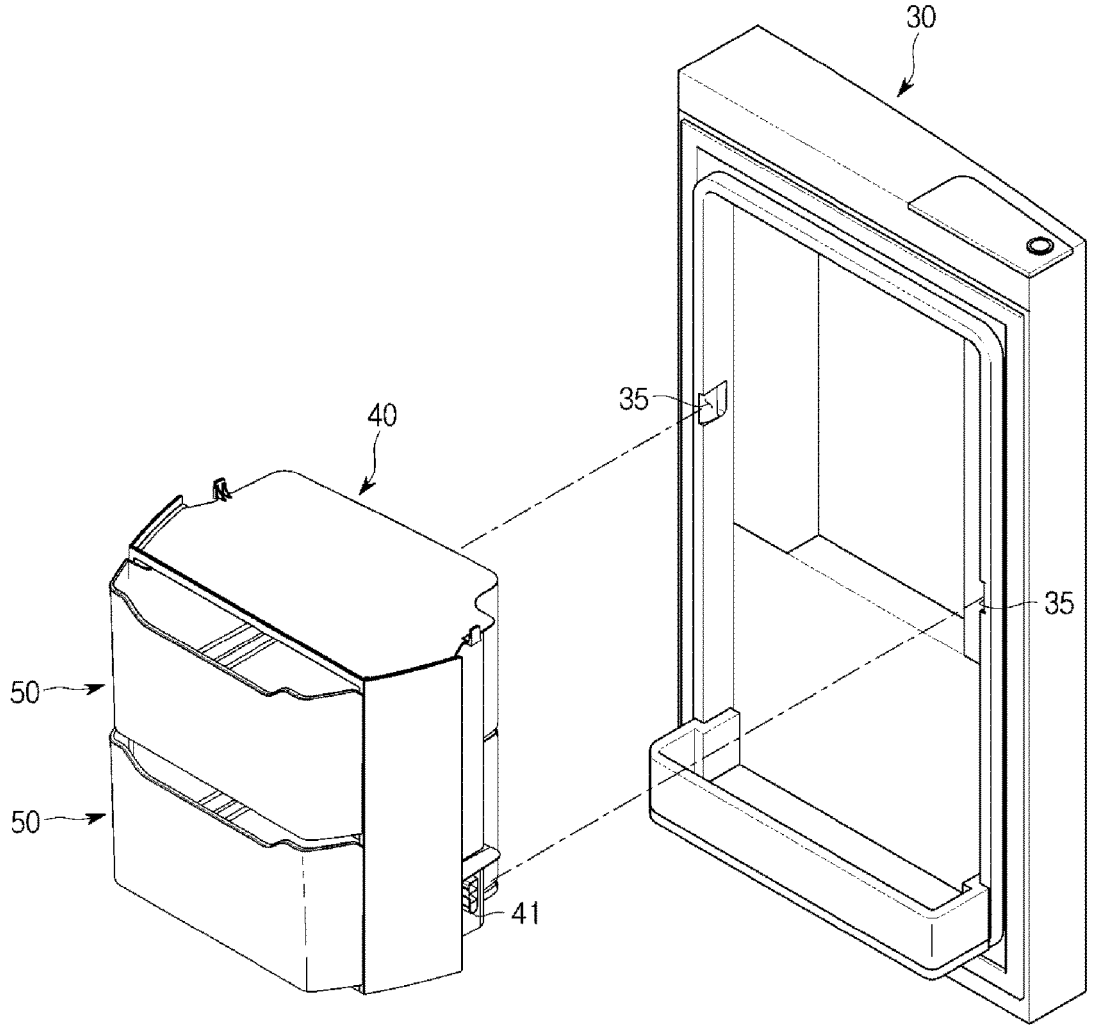
FIG. 2 shows a state when a case accommodating a container according to an embodiment of the disclosure is fixed at a door.
Figure 3:
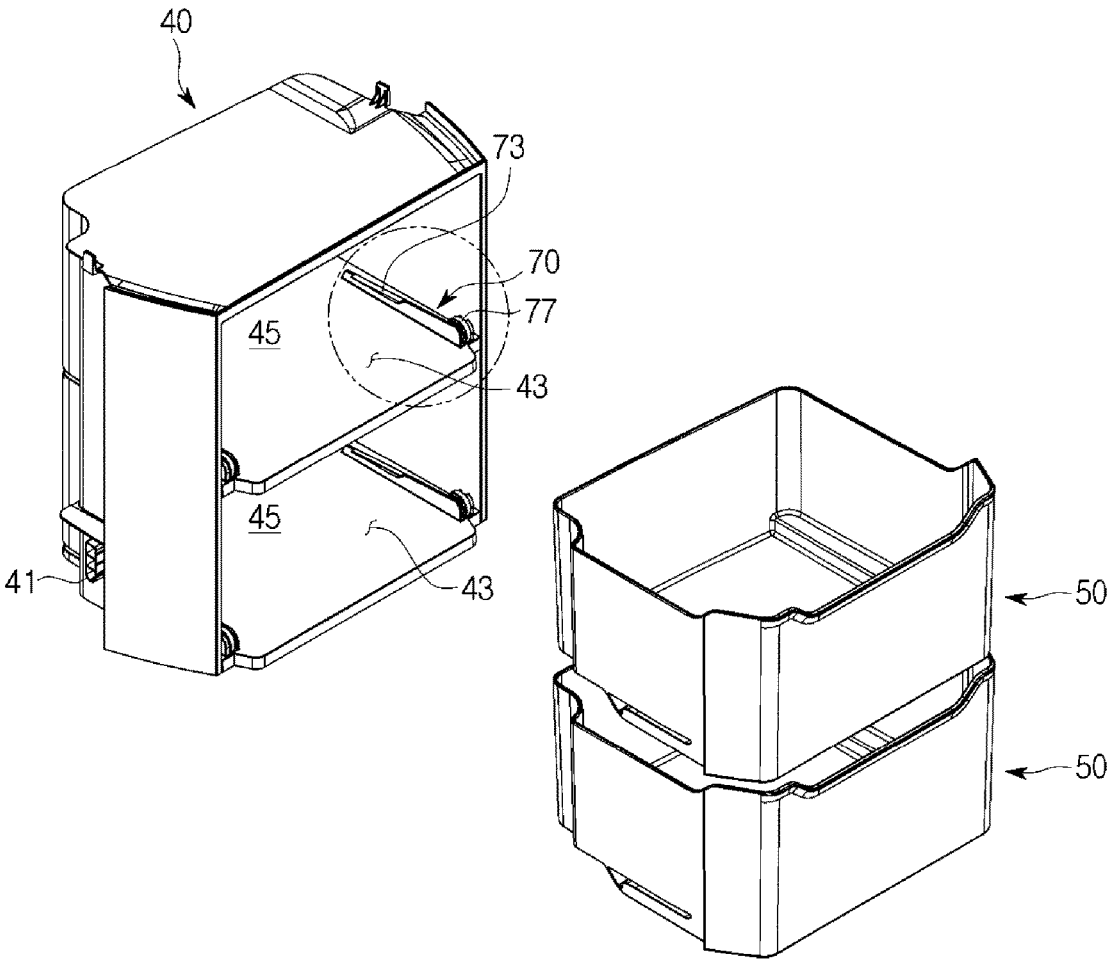
FIG. 3 shows a state when a container according to an embodiment of the disclosure is separated from a case.
Figure 4:
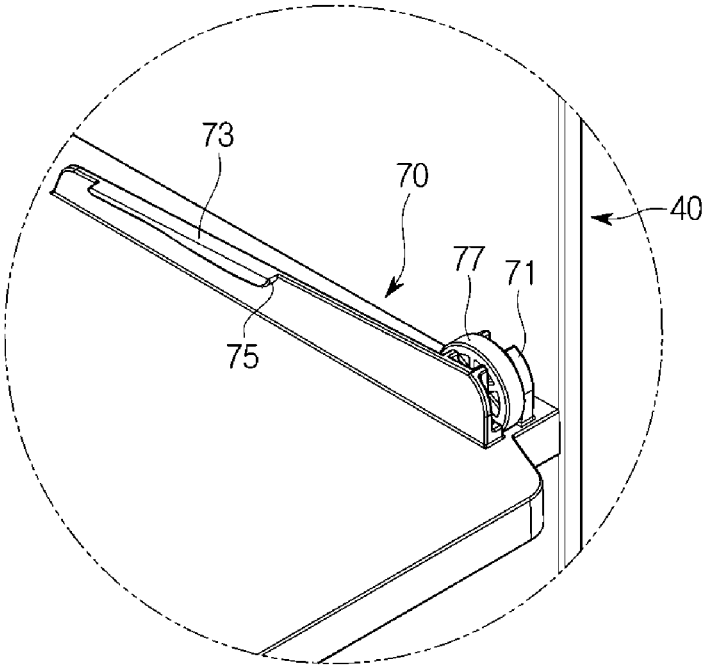
FIG. 4 is an enlarged view of a guide portion installed in a case according to an embodiment of the disclosure.
Figure 5:
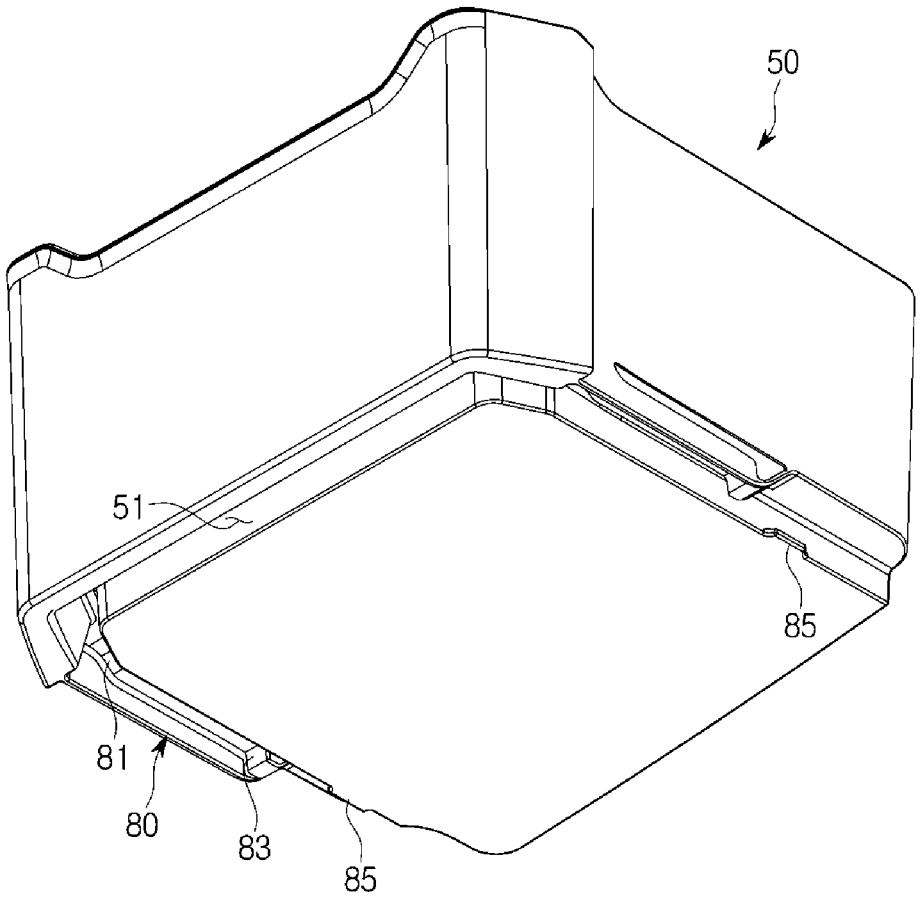
FIG. 5 shows a guide rail formed in the bottom of a container according to an embodiment of the disclosure.
Figure 6:
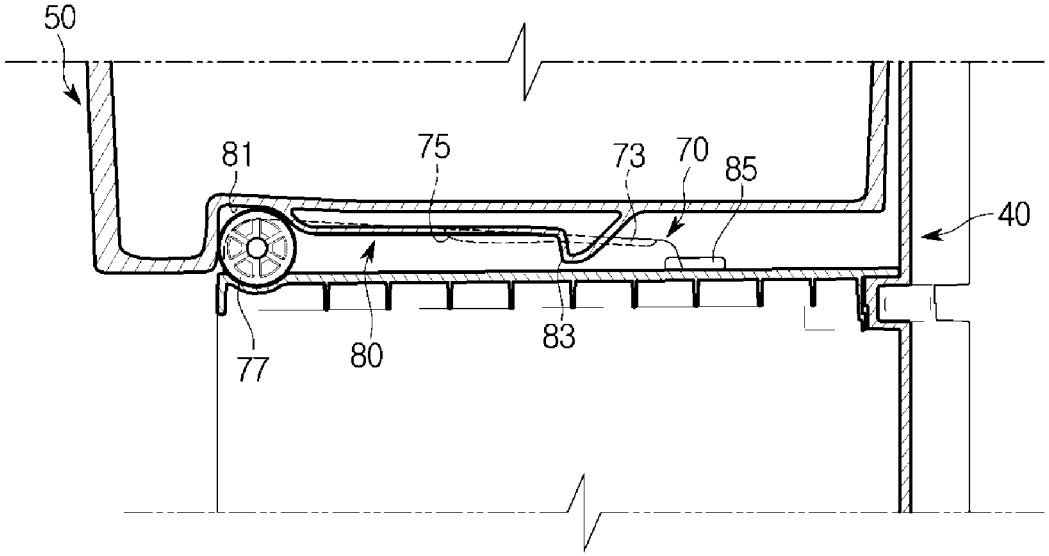
FIG. 6 shows a state in which a container according to an embodiment of the disclosure is accommodated in the inside of a case.

FIG. 1 is a perspective view of a refrigerator according to an embodiment of the present disclosure, FIG. 2 shows a state when a case accommodating a container according to an embodiment of the present disclosure is fixed at a door, FIG. 3 shows a state when a container according to an embodiment of the present disclosure is separated from a case, FIG. 4 is an enlarged view of a guide portion installed in a case according to an embodiment of the present disclosure, FIG. 5 shows a guide rail formed in the bottom of a container according to an embodiment of the present disclosure, and FIG. 6 shows a state in which a container according to an embodiment of the present disclosure is accommodated in the inside of a case.

As shown in FIG. 1, a refrigerator may include a main body 10, a storage chamber 20 formed in the inside of the main body 10, wherein the front part of the storage chamber 20 opens, and a door 30 rotatably coupled with the front surface of the main body 10 and configured to open or close the opened front part of the storage chamber 20.

The main body 10 may include an inner cabinet 11 forming the storage chamber 20, an outer cabinet 13 forming the outer appearance of the refrigerator, and a cool-air supply apparatus (not shown) configured to supply cool air to the storage chamber 20.

The cool-air supply apparatus may include a compressor (not shown), a condenser (not shown), an expansion valve (not shown), an evaporator (not shown), a blow fan (not shown), a cool-air duct (not shown), etc., and an insulator (not shown) may be filled between the inner cabinet 11 and the outer cabinet 13 of the main body 10 to prevent cool air from leaking out of the storage chamber 20.

In the rear lower portion of the main body 10, a machine room (not shown) in which the compressor for compressing refrigerant and the condenser for condensing the compressed refrigerant are installed may be provided.

The storage chamber 20 may be partitioned into a plurality of storage chambers 50 by a partition 15. In the inside of the storage chamber 20, a plurality of shelves 25 and a plurality of storage boxes 26 to store food, etc., and an ice-making device 27 to make ice cubes may be provided, wherein the opened front part of the storage chamber 20 may be opened or closed by the door 30.

The partition 15 may be partitioned into a plurality of storage chambers 21, 22, 23, and 24 by the partition 15. The partition 15 may include a first partition 17 disposed to cross the storage chamber 20 horizontally to partition the storage chamber 20 into a upper storage chamber 21 and a lower storage chamber 22, and a second partition 19 disposed to cross the lower storage chamber 22 vertically to partition the lower storage chamber 22 into a first storage chamber 23 and a second storage chamber 24.

The partition 15 having a T-shaped structure by combining the first partition 17 with the second partition 19 may partition the storage chamber 20 into three spaces.

The upper storage chamber 21 partitioned by the first partition 17 may be used as a refrigerating chamber, and the lower storage chamber 22 may be used as a freezing chamber.

The entire lower storage chamber 22 may be used as a freezing chamber. Also, the first storage chamber 23 may be used as a freezing chamber, and the second storage chamber 24 may be used as a refrigerating chamber. Also, the first storage chamber 23 may be used as a freezing chamber, and the second storage chamber 24 may be used as both a freezing chamber and a refrigerating chamber.

However, the storage chambers 21, 22, 23, and 24 may be partitioned in a different manner.

The door 30 may include an upper door 31 configured to open or close the upper storage chamber 21, and a lower door 33 configured to open or close the lower storage chamber 22. On the rear surface of the door 30, a plurality of containers 50 may be installed to store food, etc.

Hereinafter, a case 40 coupled with the rear surface of the door 30, and the containers 50 removably accommodated in the inside of the case 40 and configured to slide by a sliding apparatus to be inserted into or pulled out of the case 40 will be described in detail.

As shown in FIG. 2, a protrusion 41 may be formed on the rear surfaces of both side walls of the case 40, and a fixing groove 35 which the protrusion 41 is inserted into and fixed at may be formed in the rear surface of the door 30.

By inserting the protrusion 41 into the fixing groove 35, for example, the case 40 may be fixed on the rear surface of the door 30 such that the rear surface of the case 40 faces the rear surface of the door 30.

As shown in FIG. 3, an opening 43 may be formed in the front portion of the case 40, and a plurality of container accommodating portions 45 for accommodating the containers 50 may be formed in the inside of the case 40.

In FIG. 3, two container accommodating portions 45 are shown, however, a single container accommodating portion 45 or two or more container accommodating portions 45 may be formed.

The containers 50 accommodated in the inside of the case 40 may be slidingly moved by the sliding apparatus to be inserted into or pulled out of the case 40 through the opening 43.

As shown in FIGS. 3 to 6, the sliding apparatus may include a guide rail 80 formed in both edges of the bottom of each container 50, and a guide portion 70 disposed in the case 40 to correspond to the location of the guide rail 80 and configured to guide the guide rail 80.

The guide portion 70 may be disposed in both edges of the bottom of the container accommodating portion 45 of the case 40, in such a way to be inclined upwardly toward the front end from the rear end.

Since a user may grip a handle 51 that is, for example, upwardly concave from the front lower end of the container 50 to pull the container 50 out of the case 40, the front portion of the container 50 may be lifted upward when the container 50 is pulled out of the case 40.

Since the front portion of the container 50 may be lifted upward when the container 50 is pulled out of the case 40, the guide portion 70 supporting the guide rail 80 of the container 50 may be inclined upwardly toward the front end from the rear end.

The guide portion 70 may guide the side surfaces of the guide rail 80. In the front end of the guide portion 70, a roller coupling portion 71 may be formed to be coupled with a roller 77, and in the rear end of the guide portion 70, a fixing rib 73 may be formed to prevent the container 50 from moving upward or downward.

The roller 77 rotatably coupled with the roller coupling portion 71 may guide the guide rail 80 to enable the container 50 to smoothly slide.

The roller 77 may fix the container 50, while enabling the container 50 to smoothly slide.

The fixing rib 73 may be formed at the rear end of the upper surface of the guide portion 70, and at the front end of the fixing rib 73, and include an edge that may be formed upward in a streamlined shape.

On the lower surface of the fixing rib 73, a supporting rib 85 formed in the container 50 may be supported. Since the upper surface of the supporting rib 85 may be supported by the lower surface of the fixing rib 73 when the container 50 is pulled out of the case 40, the container 50 can be prevented from moving upward or downward when it is pulled out of the case 40.

A streamlined shape 75 formed in the front end of the fixing rib 73 may function to easily separate the container 50 pulled out of the case 40 from the case 40, which will be described in detail, later.

The guide rail 80 may be formed in both edges of the bottom of the container 50 to correspond to the guide portion 70 of the case 70.

The guide rail 80 may be guided by the guide portion 70 and the roller 77 to slide in a front-rear direction.

In the front end of the guide rail 80, a stopper groove 81 may be formed in which the roller 77 is accommodated when the container 50 is accommodated in the inside of the case 40, and in the rear end of the guide rail 80, a stopper 83 may be formed to be fixed at the roller 77 when the container 50 is pulled out of the case 40.

The stopper groove 81 may be formed in the front end of the guide rail 80, and when the container 50 is accommodated in the inside of the case 40, the stopper groove 81 may accommodate the roller 77 therein to fix the container 50.

Since the container 50 is fixed by the stopper groove 81 when the container 50 is accommodated in the inside of the case 40, the container 50 can be prevented from moving in the front-rear direction.

The stopper 83 may be formed in the rear end of the guide rail 80, and fixed by the roller 77 when the container 50 is pulled out of the case 40, thereby fixing the container 50.

Since the container 50 may be fixed by the stopper 83 in the state in which the container 50 is pulled out of the case 40, the movement distance of the container 50 may be limited so that the container 50 is no longer pulled out and stops after it is pulled out by a predetermined distance.

The container 50 may include the supporting rib 85 supported by the fixing rib 73 of the case 40 in order to prevent the container 50 from moving upward or downward when the container 50 is inserted into or pulled out of the case 40.

Since the upper surface of the supporting rib 85 is supported by the lower surface of the fixing rib 73 when the container 50 is inserted into or pulled out of the case 40, the container 50 can be prevented from moving.

An operation in which the container 50 is pulled out and separated from the case 40 will be described in detail with reference to FIGS. 6 to 10.

Figure 7:
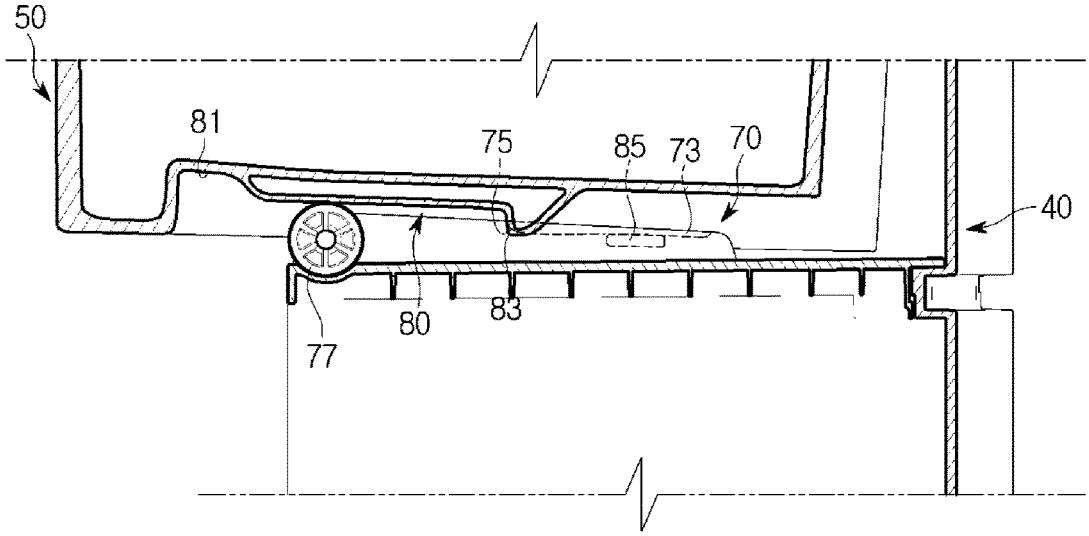
FIG. 7 shows a state when the container moves in the front direction in the state of FIG. 6.
Figure 8:
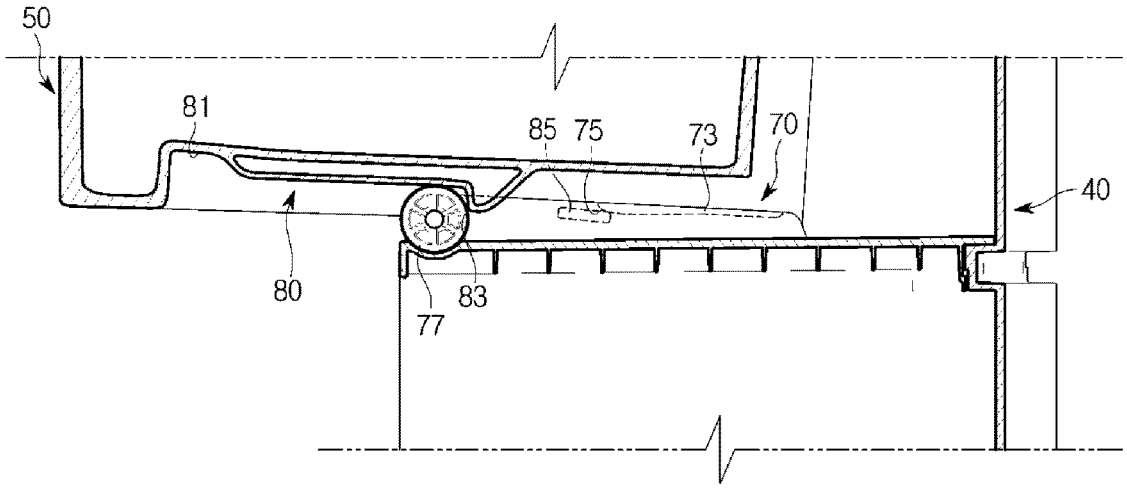
FIG. 8 shows a state when the container according to an embodiment of the disclosure is pulled out of the case.
Figure 9:
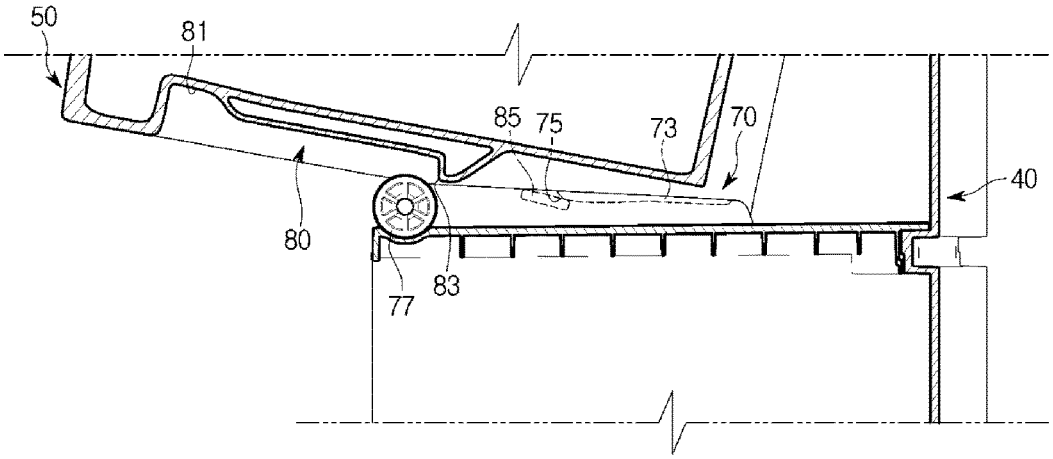
FIG. 9 shows a state when the front portion of the container is lifted upward in the state of FIG. 8.
Figure 10:
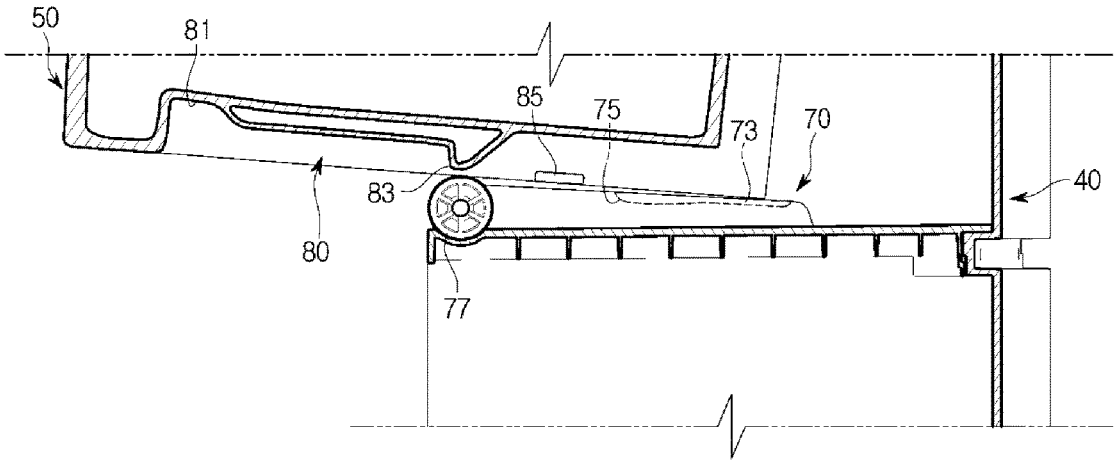
FIG. 10 shows a state when the container is separated from the case in the state of FIG. 9.

FIG. 7 shows a state when the container moves in the front direction in the state of FIG. 6, FIG. 8 shows a state when the container according to an embodiment of the present disclosure is pulled out of the case, FIG. 9 shows a state when the front portion of the container is lifted upward in the state of FIG. 8, and FIG. 10 shows a state when the container is separated from the case in the state of FIG. 9.

As shown in FIG. 6, while the container 50 is accommodated in the inside of the case 40, the roller 77 may be accommodated in the stopper groove 81 to fix the container 50, so that the container 50 can be prevented from moving in the front-rear direction when a user opens or closes the door 30.

While the container 50 is accommodated in the inside of the case 40, the supporting rib 85 may be spaced from the fixing rib 73 without being supported by the fixing rib 73. The reason is because while the container 50 is accommodated in the inside of the case 40, the bottom of the container 50 contacts the bottom of the container accommodating portion 45 to be supported by the bottom of the container accommodating portion 45 so that the supporting rib 85 does not need to be supported by the fixing rib 73.

As shown in FIG. 7, if the user pulls the container 50 in the front direction in order to take the container 50 out of the case 40, the roller 77 and the guide portion 70 may guide the guide rail 80 to slide in the front direction so that the container 50 moves in the front direction.

When the container 50 is pulled out of the case 40 in the front direction, the front portion of the container 50 may be lifted upward, so that the front portion of the container 50 is pulled out upward, and the upper surface of the supporting rib 85 contacts the lower surface of the fixing rib 73 and is supported by the lower surface of the fixing rib 73.

As shown in FIG. 8, if the stopper 83 is fixed by the roller 77 when the container 50 is pulled out in the front direction, the container 50 may be no longer pulled out in the front direction and stop.

Since the supporting rib 85 may be supported by the front end of the fixing rib 73 and maintained, the front portion of the container 50 may be prevented from tilting downward.

If the user pulls the container 50 in the front direction while lifting the front portion of the container 50 upward in the state in which the container 50 is pulled out of the case 40, as shown in FIG. 9, the supporting rib 85 may be guided by the streamlined shape 75 of the fixing rib 73 so that the front end of the container 50 may be lifted upward, and thus the container 50 can be easily separated from the case 40, as shown in FIG. 10.

An exemplary embodiment for separating a container from a case will be described with reference to FIGS. 11 to 20.

Figure 11:
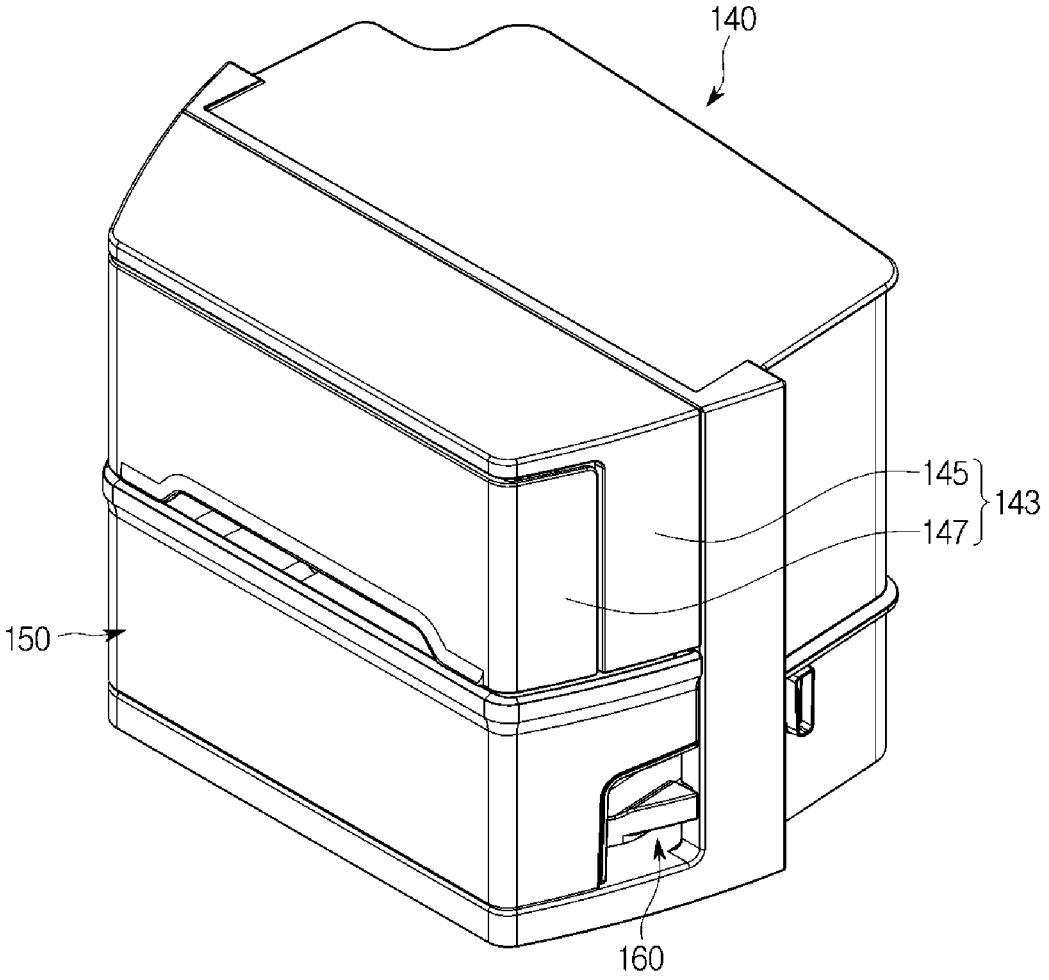
FIG. 11 is a perspective view showing a state in which a container is accommodated in the inside of a case according to an embodiment of the disclosure.
Figure 12:
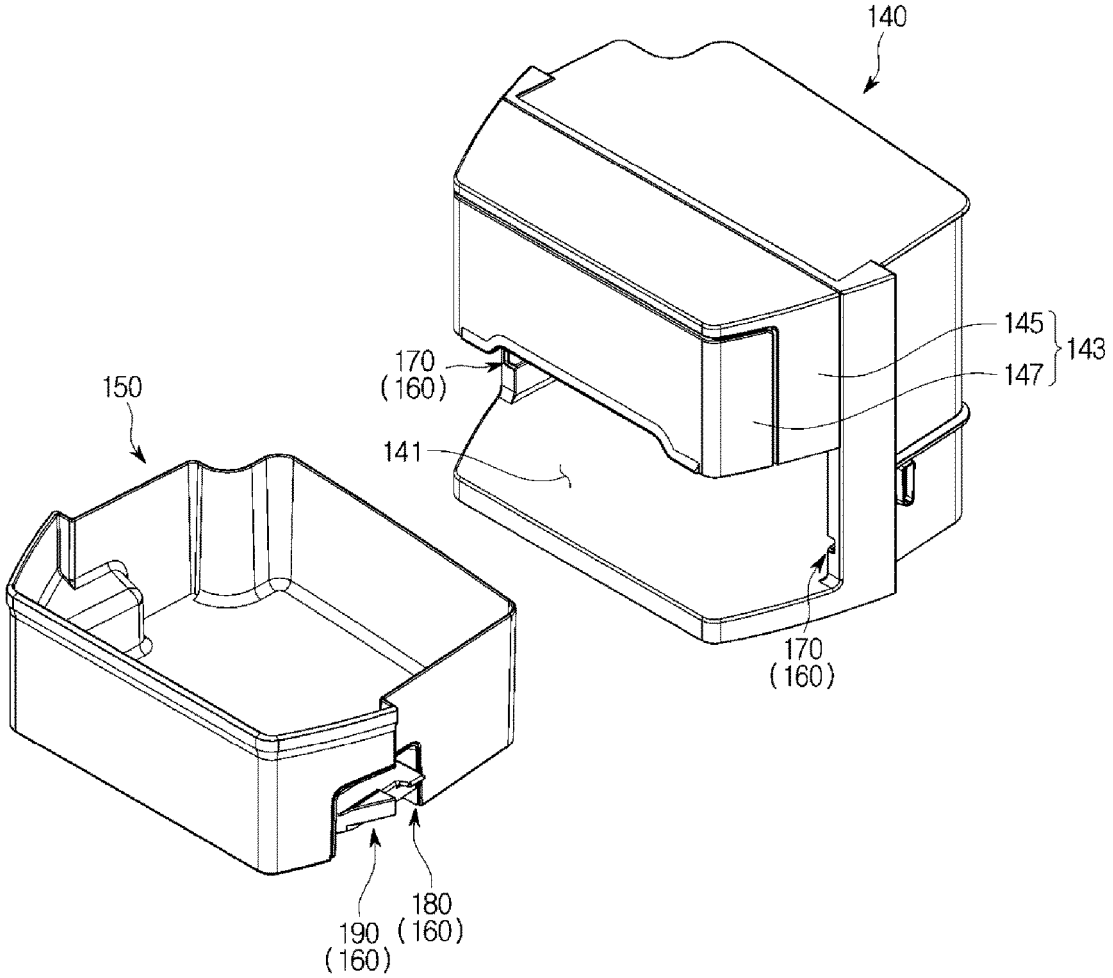
FIG. 12 is a perspective view showing a state in which a container according to an embodiment of the disclosure is separated from the case.
Figure 13:
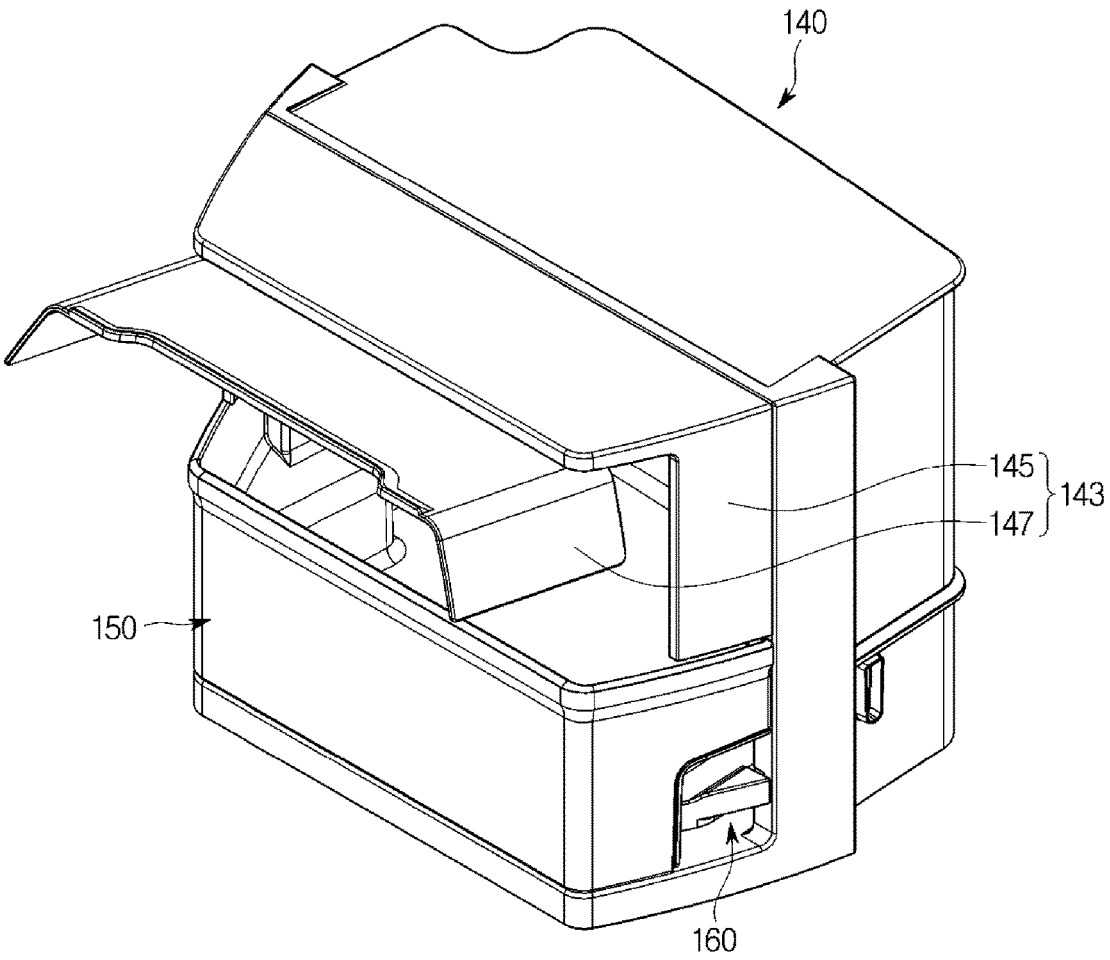
FIG. 13 shows a state in which a front cover according to an embodiment of the disclosure opens.
Figure 14:
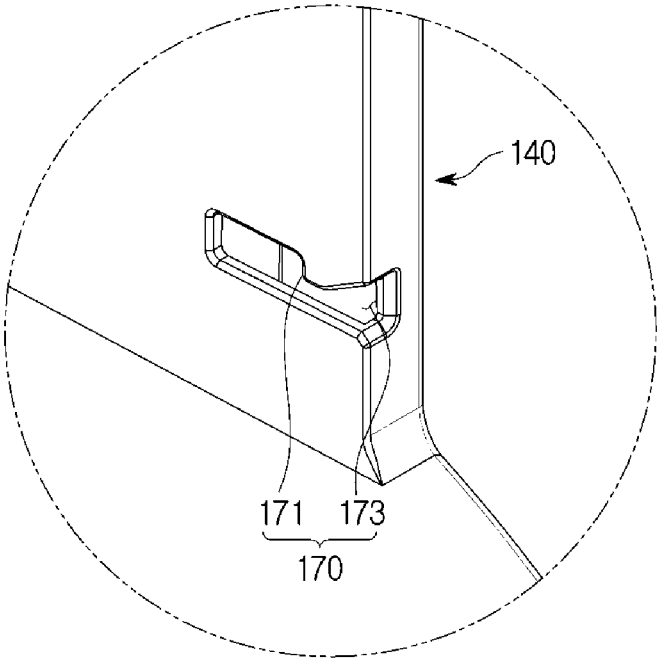
FIG. 14 is an enlarged view of a fixing hole formed in the case according to an embodiment of the disclosure.
Figure 15:
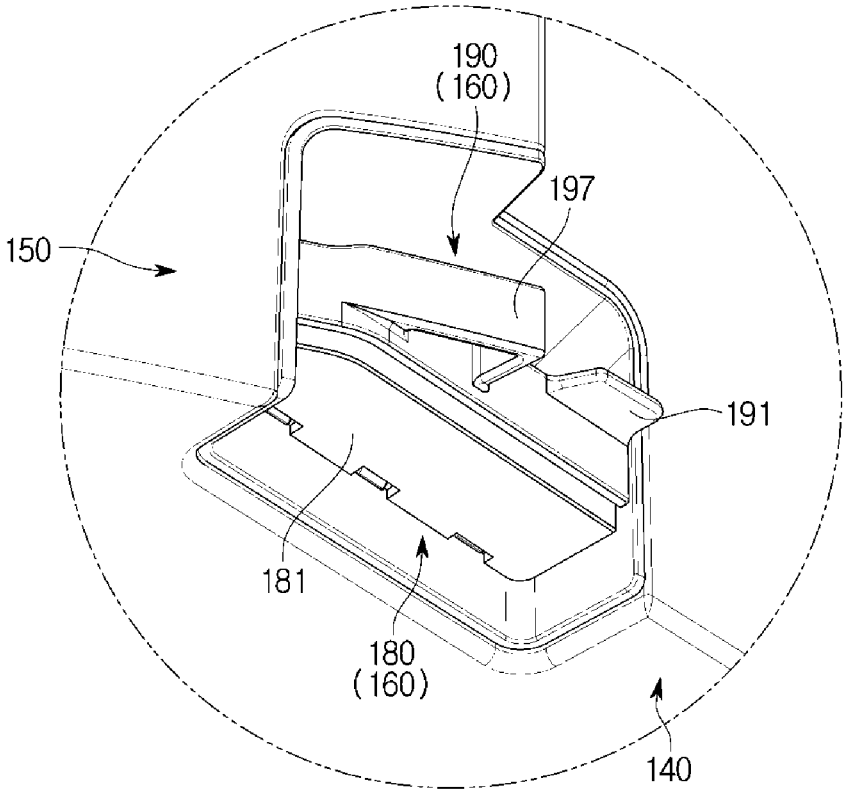
FIG. 15 shows a lever and a lever case coupled with the container according to an embodiment of the disclosure.
Figure 16:
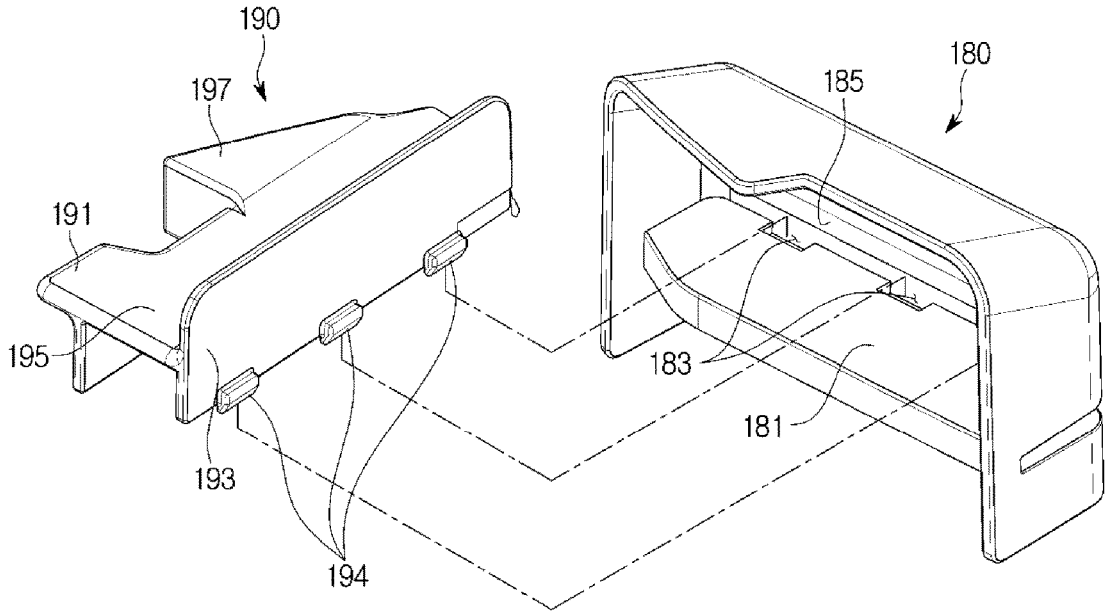
FIG. 16 shows a state when the lever is coupled with the lever case according to an embodiment of the disclosure.
Figure 17:
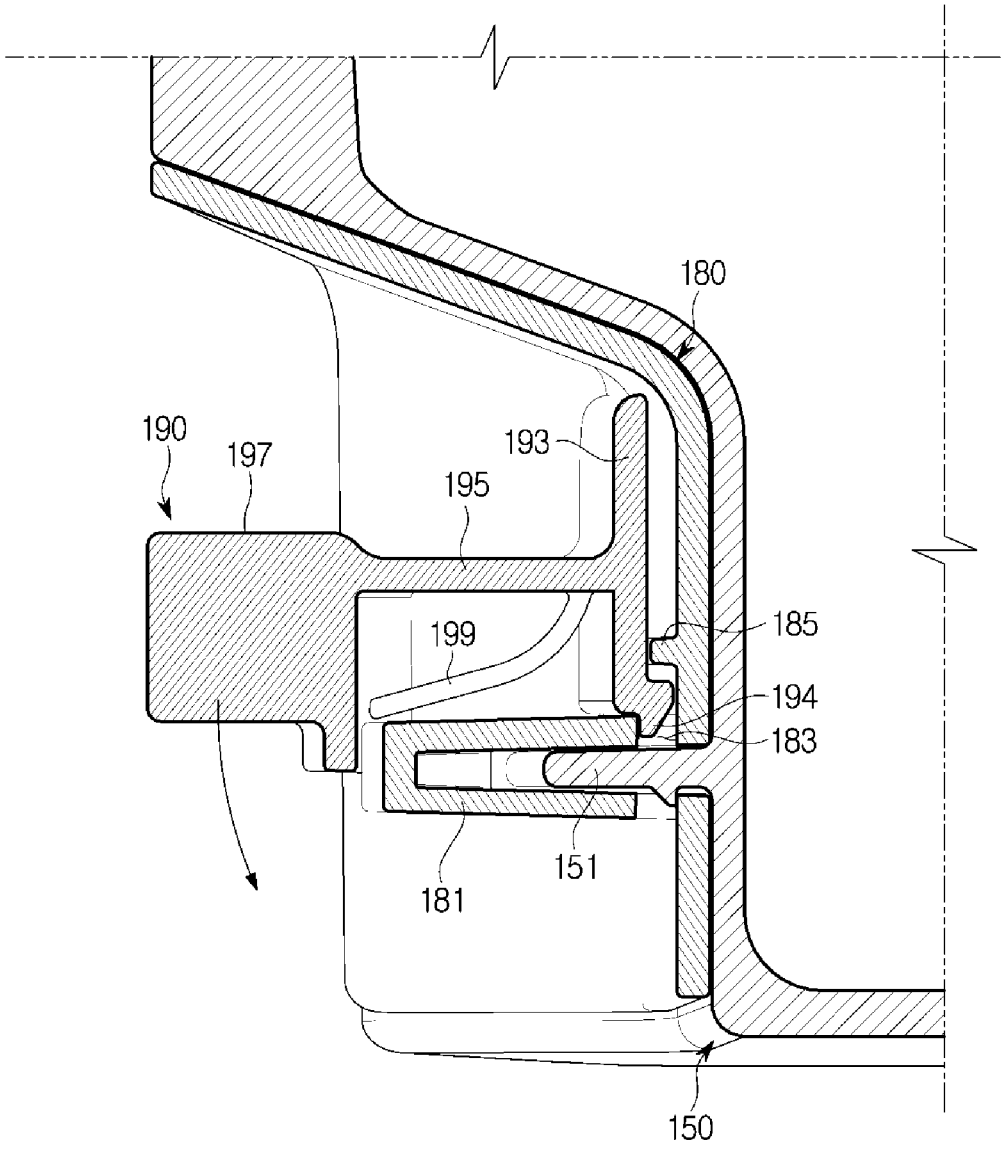
FIG. 17 is a cross-sectional view showing a state in which the lever is coupled with the lever case according to an embodiment of the disclosure.
Figure 18:
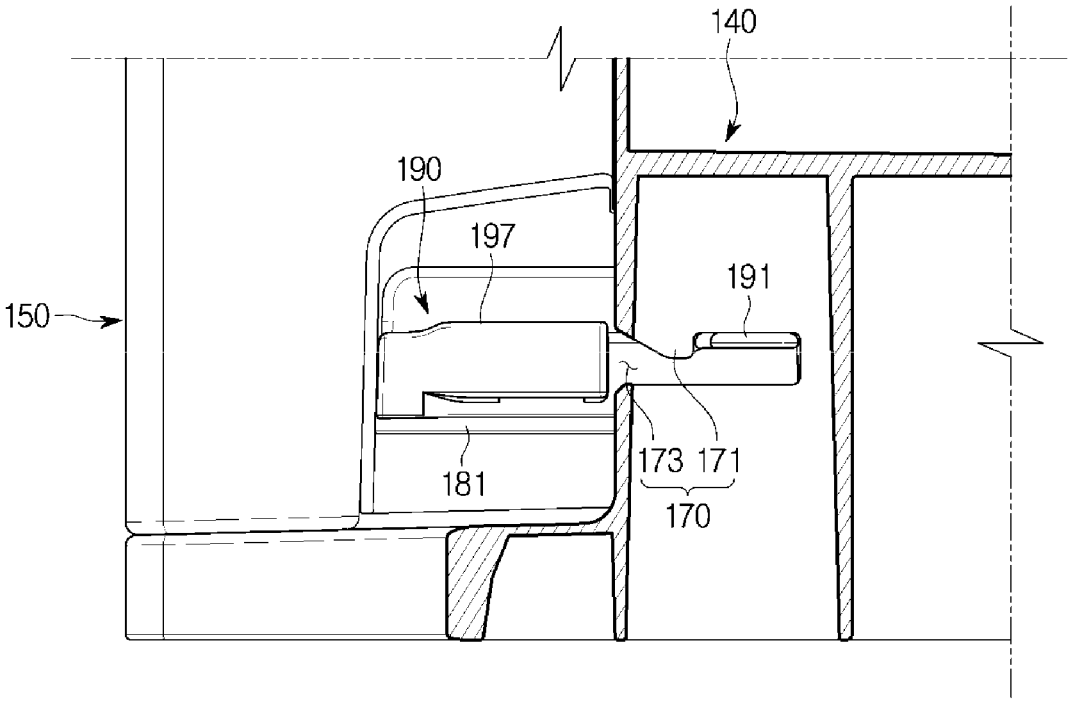
FIG. 18 shows a state in which a fixing protrusion according to an embodiment of the disclosure is fixed at a fixing portion.
Figure 19:
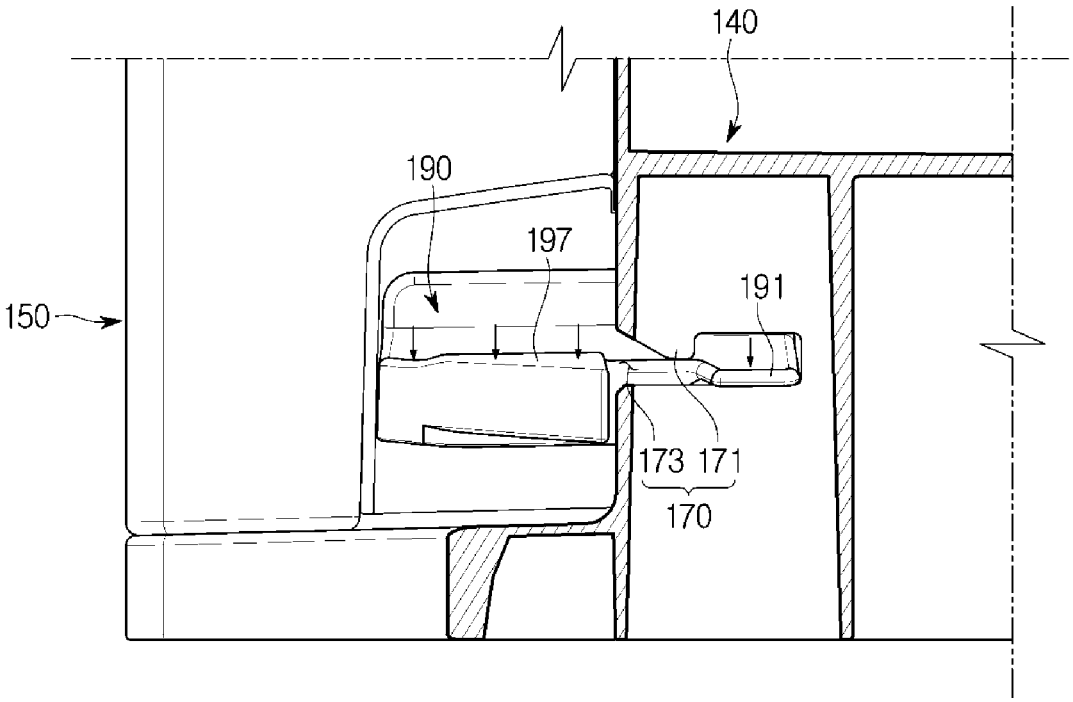
FIG. 19 shows a state when the lever rotates so that the fixing protrusion is released from the fixing portion in the state of FIG. 18.
Figure 20:
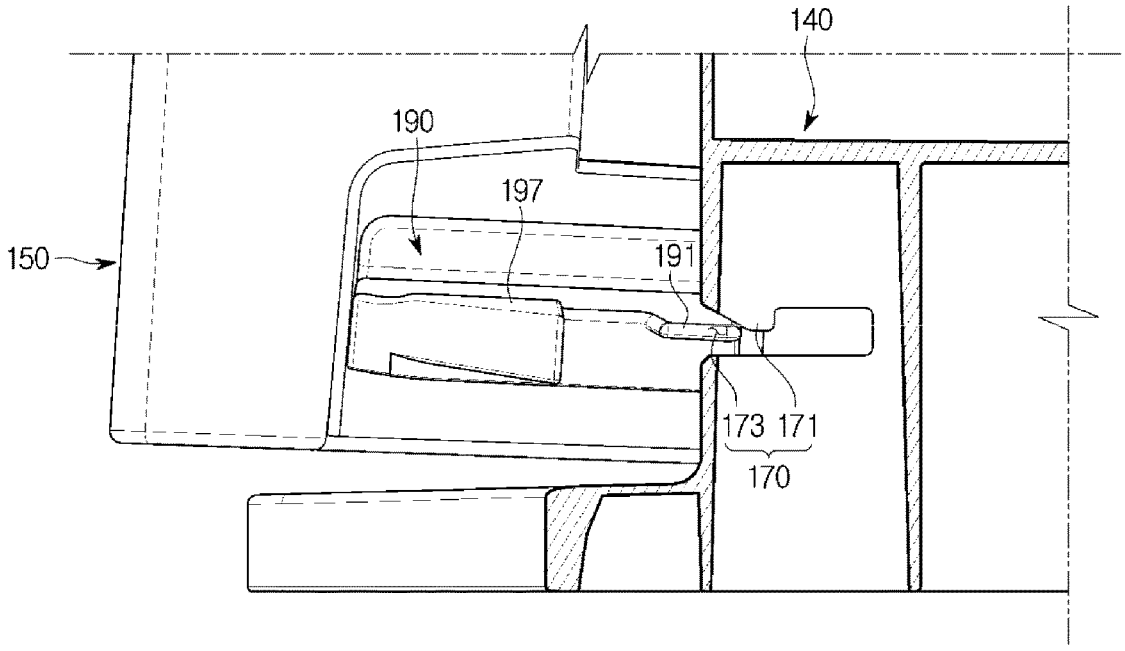
FIG. 20 shows a state when the container moves in the front direction in the state of FIG. 19 so that the fixing protrusion escapes from the fixing hole through an exit portion.

FIG. 11 is a perspective view showing a state in which a container is accommodated in the inside of a case according to an embodiment of the present disclosure, FIG. 12 is a perspective view showing a state in which a container according to an embodiment of the present disclosure is separated from the case, FIG. 13 shows a state in which a front cover according to an embodiment of the present disclosure opens, FIG. 14 is an enlarged view of a fixing hole formed in the case according to an embodiment of the present disclosure, FIG. 15 shows a lever and a lever case coupled with the container according to an embodiment of the present disclosure, FIG. 16 shows a state when the lever is coupled with the lever case according to an embodiment of the present disclosure, FIG. 17 is a cross-sectional view showing a state in which the lever is coupled with the lever case according to an embodiment of the present disclosure, FIG. 18 shows a state in which a fixing protrusion according to an embodiment of the present disclosure is fixed at a fixing portion, FIG. 19 shows a state when the lever rotates so that the fixing protrusion is released from the fixing portion in the state of FIG. 18, and FIG. 20 shows a state when the container moves in the front direction in the state of FIG. 19 so that the fixing protrusion escapes from the fixing hole through an exit portion.

A configuration in which a case 140 is coupled with the rear surface of the door 30 has been described above with reference to FIG. 2, and accordingly, a detailed description thereof will be omitted.

As shown in FIGS. 11 to 13, a container 150 may be accommodated in the inside of the case 140, and may be fixed in or released from the case 140 by a fixing apparatus 160.

The container 150 may be accommodated in the lower space of the case 140. The upper part of the container 150 may open, and the container 150 may be inserted into or pulled out of the case 140 through an opening 141.

To cover the opened upper part of the container 150, the case 140 may include a cover 143. The cover 143 may include a rear cover 145 fixed at the case 140, and a front cover 147 rotatably coupled with the front portion of the rear cover 145.

Since the front cover 147 may be rotatably coupled with the rear cover 145, a user can approach the inside of the container 150 through the front cover 147 in the state in which the container 150 is accommodated in the inside of the case 140 and fixed at the case 140.

However, when the user puts/takes food, etc. in/out of the container 150 through the front cover 147, the user may be inconvenienced in using the rear area of the inside of the container 150 since they may easily approach only the front area of the inside of the container 150.

A user may release the container 150 from the case 140 through the fixing apparatus 160, and separate the container 150 from the case 140 so that they can easily approach the inside space of the container 150.

The fixing apparatus 160 may include a fixing hole 170 formed in both side walls of the case 140 and configured to fix or release the container 150, a lever case 180 coupled with both side walls of the container 150, and a lever 190 coupled with the lever case 180.

As shown in FIG. 14, the fixing hole 170 may include a fixing portion 171 configured to fix or release the lever 190 so as to fix the container 150 at the case 140 or to release the container 150 from the case 140, and an exit portion 173 configured to enable the container 150 released from the fixing portion 171 to be pulled out.

The width of the exit portion 173 may increase gradually toward the front direction from the fixing portion 171 so that a fixing protrusion 191 (will be described later) fixed at the fixing portion 171 can easily escape through the exit portion 173.

As shown in FIGS. 15, 16, and 17, the lever case 180 may be coupled with the side walls of the container 150.

A coupling rib 151 may be formed in the side walls of the container 150 to be coupled with the lever case 180, and the coupling rib 151 may be inserted into a handle 181 of the lever case 180 so that the lever case 180 can be coupled with the side walls of the container 150.

As shown in FIGS. 15, 16, and 17, the lever 190 may be coupled with the lever case 180 coupled with the side walls of the container 150.

The lever case 180 may include the handle 181 inserted into the coupling rib 151 formed in the side walls of the container 150, a plurality of coupling holes 183 which are formed in one edge of the handle 181 and with which the lever 190 is coupled, and a fixing rib 185 formed above the plurality of coupling holes 183 and spaced from the plurality of coupling holes 183.

The handle 181 may have a cloven shape such that it can be inserted into the coupling rib 151 formed in the side walls of the container 150. A user may grip the handle 181 to separate the container 150 from the case 140 or to fix the container 150 in the case 140.

The lever 190 may include a plurality of coupling protrusions 194 which will be described later, and the plurality of coupling protrusions 194 may be inserted into and coupled with the plurality of coupling holes 183 to be fixed by the fixing rib 185.

The lever 190 may include the fixing protrusion 191 fixed at or released from the fixing portion 171 of the fixing hole 170, a coupling portion 193 on which the plurality of coupling protrusions 194 coupled with the plurality of coupling holes 183 formed in the lever case 180 are formed, an extension portion 195 extending from the coupling portion 193 and having a length that is longer than the width of the handle 181, a pressing portion 197 formed in the extension portion 195 together with the fixing protrusion 191, and an elastic portion 199 formed below the extension portion 195 and having elasticity.

While the container 150 is accommodated in the inside of the case 140, the fixing protrusion 191 may be fixed at the fixing portion 171 of the fixing hole 170 to fix the container 150 in the inside of the case 140, and when the user presses the pressing portion 197, the fixing protrusion 191 may move downward to be released from the fixing portion 191.

If the user pulls the container 150 in the front direction, the fixing protrusion 191 released from the fixing portion 171 may escape from the fixing hole 170 through the exit portion 173, and if the fixing protrusion 191 escapes from the fixing hole 170, the container 150 may be separated from the case 140.

The lower portions of the plurality of coupling protrusions 194 may be inserted into and coupled with the plurality of coupling holes 183 of the lever case 180, and the upper portions of the plurality of coupling protrusions 194 may be fixed by the fixing rib 185 such that the plurality of coupling protrusions 194 do not escape from the plurality of coupling holes 183.

The extension portion 195 may extend from the coupling portion 193, and have a length that is longer than the width of the handle 181. Accordingly, when the user presses the pressing portion 197, the extension portion 195 may enable the lever 190 to rotate with respect to the plurality of coupling protrusions 194 without contacting the handle 181.

The pressing portion 197 may be formed at the end of the extension portion 195 extending from the coupling portion 193 on which the plurality of coupling protrusions 194 are formed, together with the fixing protrusion 191. When the user presses the pressing portion 197, the lever 190 may rotate with respect to the plurality of coupling protrusions 194 so that the fixing protrusions 191 rotate upward or downward with respect to the plurality of coupling protrusions 194.

The elastic portion 199 having elasticity may be disposed below the extension portion 195 to contact the handle 181. When the user presses the pressing portion 197, the lever 190 may rotate with respect to the plurality of coupling protrusions 194 such that the pressing portion 197 moves downward, and accordingly, the elastic portion 199 may be compressed to store an elastic force. If the user removes a force pressing the pressing portion 197, the lever 190 may rotate with respect to the plurality of coupling protrusions 194 by the elastic force so that the pressing portion 197 moves upward.

Thereafter, operation of pulling the container 150 fixed in the inside of the case 140 out of the case 140 to separate the container 150 from the case 140 will be described with reference to FIGS. 18 to 20.

As shown in FIG. 18, while the container 150 is accommodated in the inside of the case 140, the fixing protrusion 191 of the lever 190 may be fixed at the fixing portion 171 of the fixing hole 170 formed in the case 140 to prevent the container 150 from escaping from the case 140.

As shown in FIG. 19, if the user presses the pressing portion 197, the lever 190 may rotate such that the pressing portion 197 moves downward, and the fixing protrusion 191 may also rotate downward together with the pressing portion 197.

If the fixing protrusion 191 rotates downward, the fixing protrusion 191 may be released from the fixing portion 171 so that the container 150 can move in the front direction.

If the user moves the container 150 in the front direction when the fixing protrusion 191 is released from the fixing portion 171, as shown in FIG. 20, the fixing protrusion 191 may escape from the fixing hole 170 through the exit portion 173, so that the container 150 may be separated from the case 140.

Since the width of the exit portion 173 increases gradually toward the front direction from the fixing portion 171, the fixing protrusion 191 may be not caught by the fixing hole 170 although the front portion of the container 150 is lifted upward, when the container 150 moves in the front direction, so that the container 150 can be easily separated from the case 140.

An exemplary embodiment of separating the container 250 from the case 240 will be described with reference to FIGS. 21 to 26.

Figure 21:
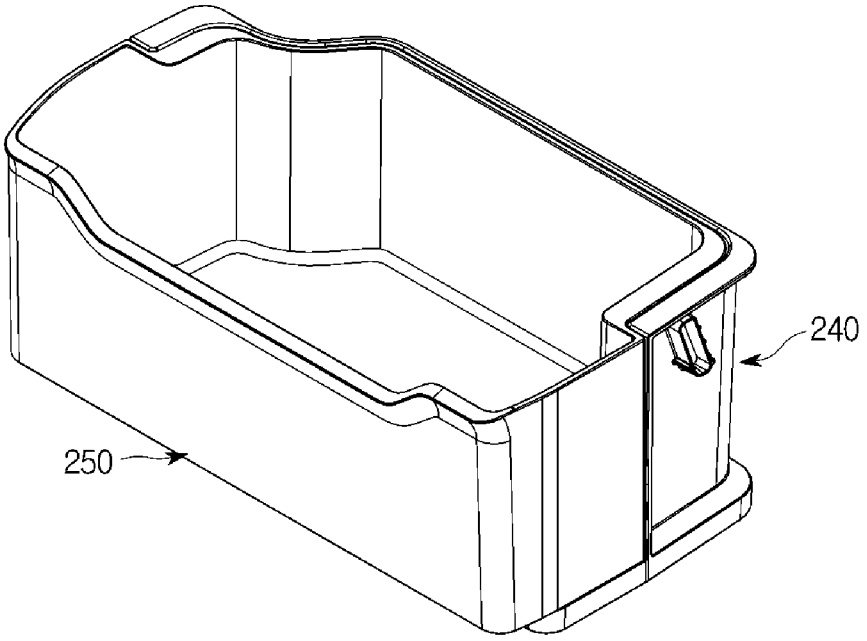
FIG. 21 is a perspective view showing a state in which a container is accommodated in the inside of a case according to an embodiment of the disclosure.
Figure 22:
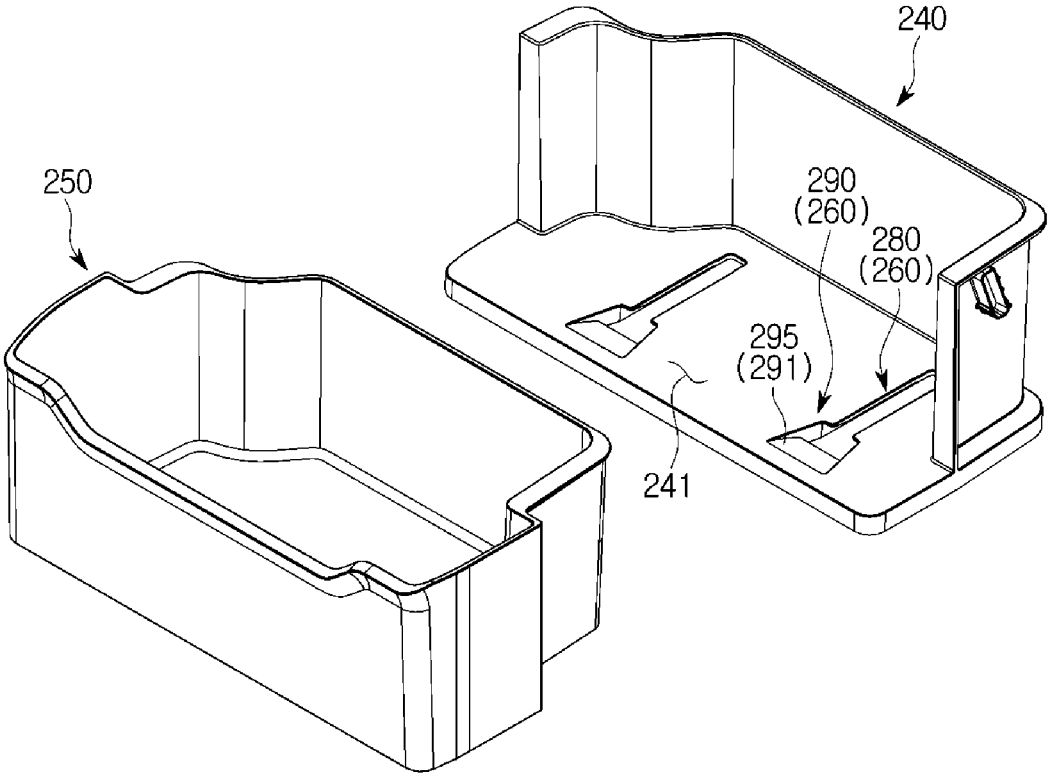
FIG. 22 is a perspective view showing a state in which a container according to an embodiment of the disclosure is separated from the case.
Figure 23:
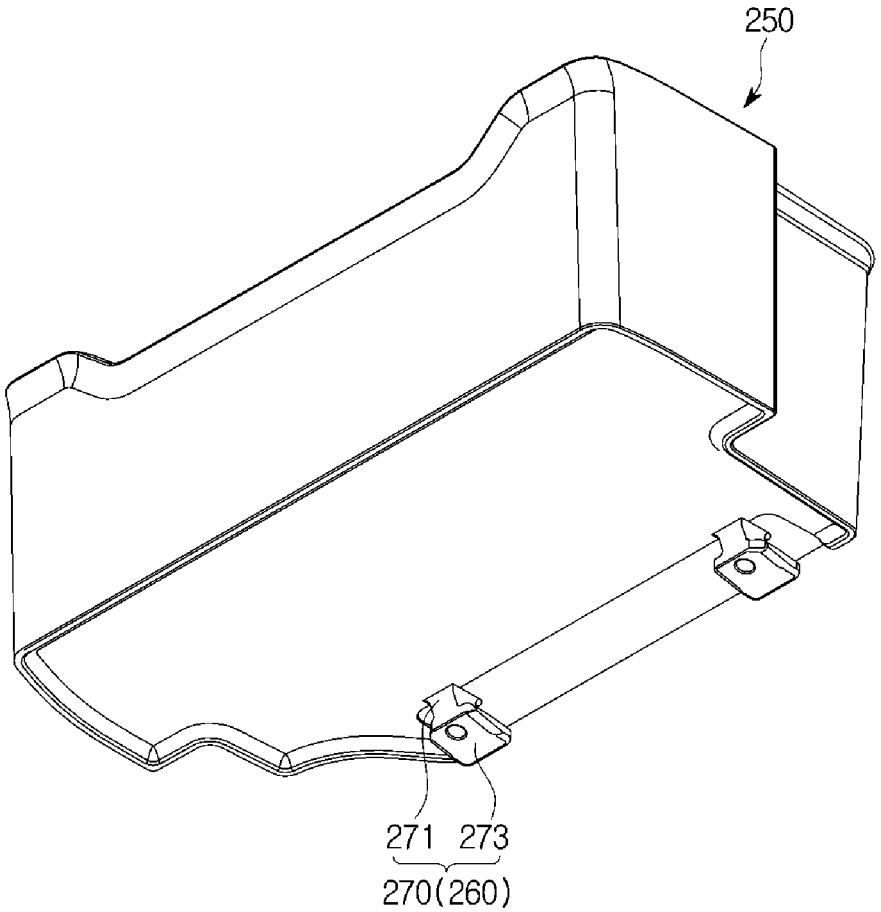
FIG. 23 is a perspective view showing the bottom of the container according to an embodiment of the disclosure.
Figure 24:
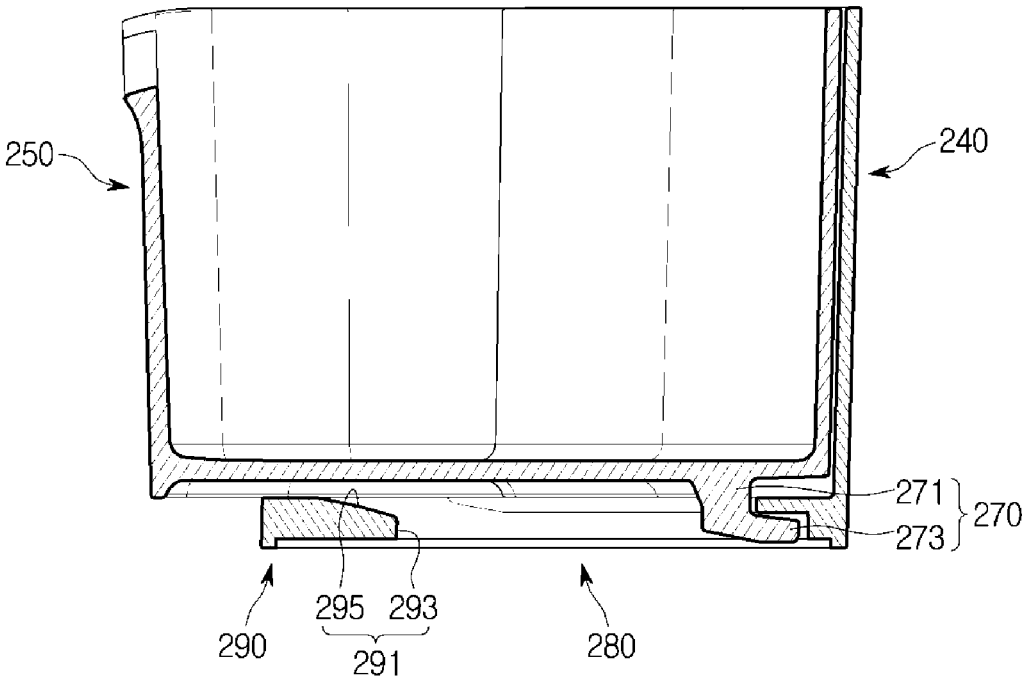
FIG. 24 is a perspective view showing a state in which the container according to an embodiment of the disclosure is accommodated in the inside of the case.
Figure 25:
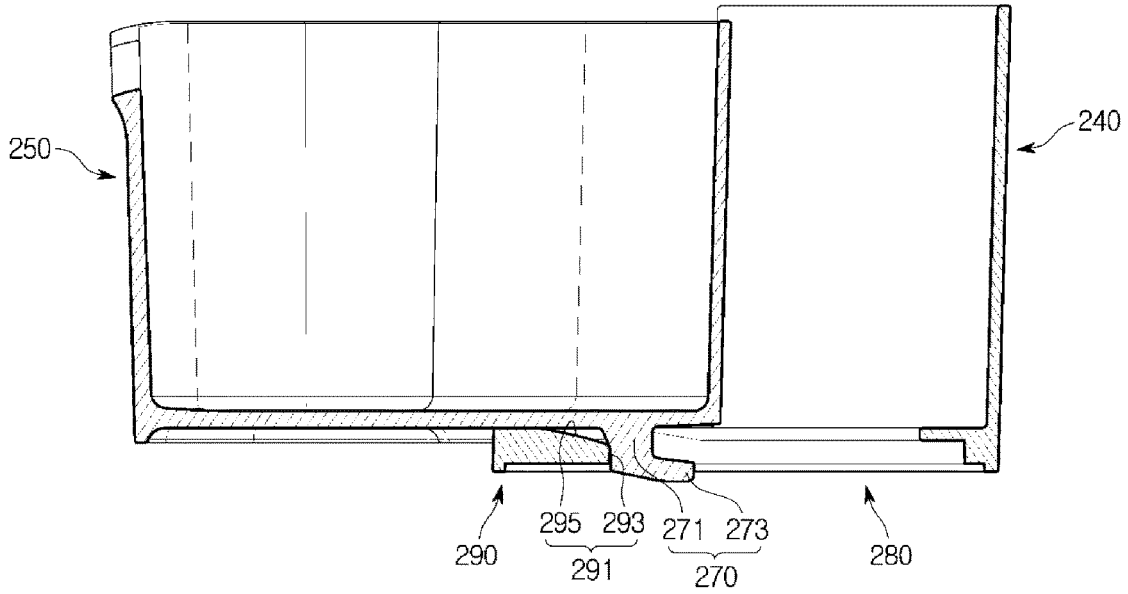
FIG. 25 shows a state when the container is pulled out of the case in the state of FIG. 24.
Figure 26:
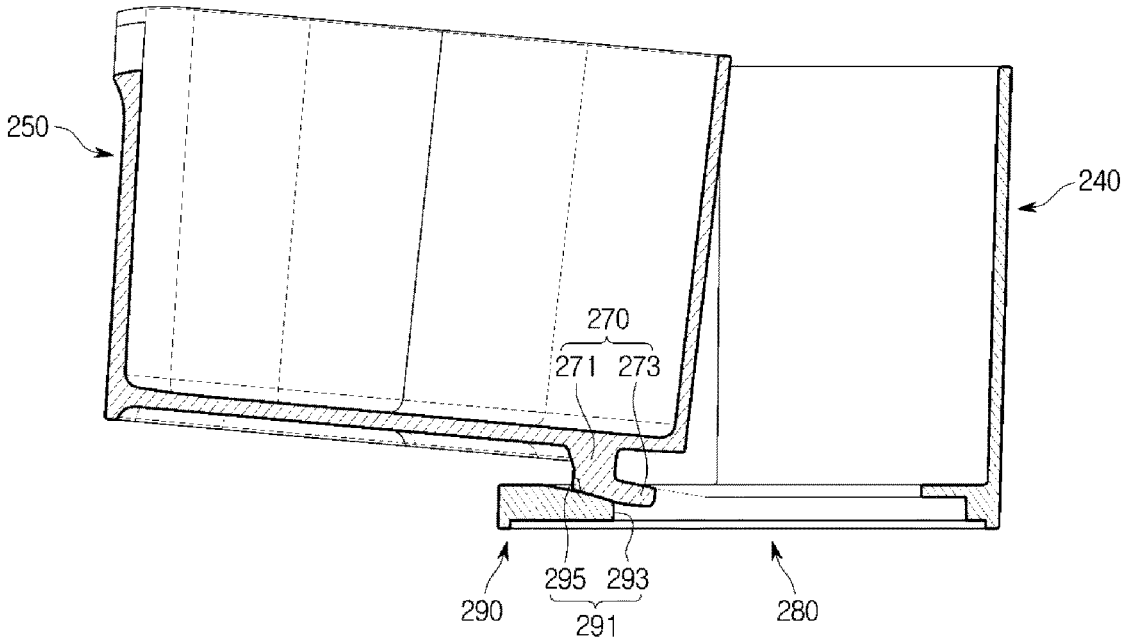
FIG. 26 shows a state when the container is separated from the case in the state of FIG. 25.

FIG. 21 is a perspective view showing a state in which a container is accommodated in the inside of a case according to an embodiment of the present disclosure, FIG. 22 is a perspective view showing a state in which a container according to an embodiment of the present disclosure is separated from the case, FIG. 23 is a perspective view showing the bottom of the container according to embodiment of the present disclosure, FIG. 24 is a perspective view showing a state in which the container according to an embodiment of the present disclosure is accommodated in the inside of the case, FIG. 25 shows a state when the container is pulled out of the case in the state of FIG. 24, and FIG. 26 shows a state when the container is separated from the case in the state of FIG. 25.

As shown in FIGS. 21 to 23, a case 240 may be fixed on the rear surface of the door 30 such that the rear surface of the case 240 faces the rear surface of the door 30, and in the front part of the case 240, an opening 241 may be formed.

A container 250 that is inserted into or pulled out of the case 240 through the opening 241 may be accommodated in the inside of the case 240, and the upper part of the container 250 may open.

The container 250 may be positioned below the ice-making apparatus 27 when the door 30 is in a closed state, and at this time, the container 250 may be used to store ice cubes made by the ice-making apparatus 27 (see FIG. 1).

The container 250 accommodated in the inside of the case 240 may slide by a sliding apparatus 260 so as to be inserted into or pulled out of the case 240 through the opening 241.

The sliding apparatus 260 may include a guide portion 270 formed in both edges of the bottom of the container 250, a guide rail 280 formed in the case 240 and configured to guide the guide portion 270, and a separating portion 290 formed in the front end of the guide rail 280 and having a width that is wider than that of the guide rail 280, wherein the upper part of the separating portion 290 opens.

The guide portion 270 may be guided by the guide rail 280 to slide in the front-rear direction, and according to movement of the guide portion 270, the container 250 may slide in the front-rear direction to be inserted into or pulled out of the case 240.

The container 250 may include a connecting portion 271 connected to the bottom of the container 250, and a guide 273 formed in the lower end of the connecting portion 271 and having a width that is wider than that of the connecting portion 271.

The width of the guide rail 280 may be narrower than that of the guide 273 in order to prevent the guide 273 from escaping from the guide rail 280, and the width of the guide rail 280 may be wider than that of the connection portion 271 so that the connecting portion 271 can move in the front-rear direction along the guide rail 280.

Since the guide 273 of the guide portion 270 moving along the guide rail 280 is positioned below the guide rail 280, the guide portion 270 can be prevented from escaping from the guide rail 280.

The separating portion 290 may be formed in the front end of the guide rail 280, and have a width that is wider than that of the guide rail 280.

The separating portion 290 may include a fixing portion 291 configured to fix the guide portion 270 moving in the front direction along the guide rail 280 so that the container 250 can be fixed.

The fixing portion 291 may include a catching portion 293 to fix the guide portion 270, and an inclined surface 295 formed in the upper surface of the catching portion 293 and inclined upward toward the front end from the rear end.

Hereinafter, operation in which the container 50 is separated from the case 40 after it is pulled out of the case 40 will be described in detail with reference to FIGS. 24 to 26.

If the user moves the container 250 in the front direction as shown in FIG. 25 when the container 250 is accommodated in the inside of the case 240 as shown in FIG. 24, the guide portion 270 may move in the front direction along the guide rail 280 so that the container 250 is pulled out through the opening 241 (see FIG. 22).

The container 250 pulled out through the opening 241 may be fixed by the guide portion 270 stopped by the catching portion 293 so that the container 250 can be prevented from moving in the front direction.

If the user moves the container 250 in the front direction while lifting the front portion of the container 250 upward when the guide portion 270 is fixed by the catching portion 293, as shown in FIG. 26, the guide portion 270 may climb over the catching portion 293 to move along the inclined surface 295.

The guide portion 270 moved along the inclined portion 295 may escape from the case 240 through the opened upper part of the separation portion 290 so as to separate the container 250 from the case 240.

Since the separating portion 290 may have a width that is wider than that of the guide 273, the guide portion 270 can be easily separated from the case 240 through the opened upper part of the separating portion 290.

According to exemplary embodiments of the present disclosure, since the container can be easily separated from the door, it is possible to efficiently use the inside space of the container.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body having a storage chamber;

a door rotatably coupled with a front surface of the main body to open or close the storage chamber;

a case fixable on a rear surface of the door, a rear surface of the case facing the rear surface of the door, and a front part of the case having an opening;

a container including a supporting rib, the container removably accommodated inside of the case; and a sliding apparatus that enables the container to be slideably inserted into or pulled out of the case through the opening of the case, wherein the sliding apparatus comprises:

a guide rail formed in both edges of a bottom of the container, a guide portion disposed in the case to guide the guide rail, wherein the guide portion is inclined upwardly toward a front end of the guide portion from a rear end of the guide portion, and a fixing rib at the rear end of the guide portion having a streamlined shape at a front end of the fixing rib, and wherein the supporting rib is supportable by a lower surface of the fixing rib, and moves in a front-rear direction while being supported on the fixing rib when the container is inserted into the case or pulled out of the case through the opening, and wherein when the container is fully inserted into the case, the supporting rib is disengaged from the fixing rib.

2. The refrigerator according to claim 1, wherein a roller coupling portion is formed in the front end of the guide portion, and a roller for guiding the guide rail to enable the container to smoothly slide is rotatably coupled with the roller coupling portion.

3. The refrigerator according to claim 2, wherein in the front end of the guide rail, a stopper groove is formed in which the roller is accommodated to fix the container when the container is accommodated in the inside of the case, and in the rear end of the guide rail, a stopper is formed and fixed at the roller to limit a movement distance of the container when the container is pulled out of the case.

4. The refrigerator according to claim 1, wherein when the container is inserted into the case or pulled out of the case through the opening, the supporting rib is supportable by the fixing rib to prevent the container from moving upward or downward, while preventing the container from escaping from the case.

5. The refrigerator according to claim 4, wherein when the container is accommodated in the inside of the case, the roller is accommodated in the stopper groove to prevent the container from moving in the front-rear direction.

6. The refrigerator according to claim 5, wherein when a user grips a handle that is upwardly concave from the front lower end of the container and pulls the container in a front direction to take the container out of the case through the opening, the roller and the guide portion guide the guide rail to move the container in the front direction, and the supporting rib is supportable by the fixing rib to be guided along the lower surface of the fixing rib to move in the front direction.

7. The refrigerator according to claim 6, wherein if the stopper is fixed by the roller when the container moves in the front direction, the container stops without moving in the front direction, and the supporting rib is supportable by the front end of the fixing rib so as to prevent the front portion of the container from tilting downward.

8. The refrigerator according to claim 7, wherein if the user grips the handle to pull the container in the front direction when the stopper is fixed at the roller so that the container is completely pulled out of the case, the supporting rib is guided by the streamlined shape of the fixing rib so that the front end of the container is lifted upward, and the container is separated from the case.

* * * * *